US010717273B2

(12) United States Patent
Nakagawa et al.

(10) Patent No.: US 10,717,273 B2
(45) Date of Patent: Jul. 21, 2020

(54) LIQUID EJECTION HEAD AND METHOD FOR CIRCULATING LIQUID

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Noriyasu Nagai, Tokyo (JP); Takuro Yamazaki, Inagi (JP); Toru Nakakubo, Kawasaki (JP); Akira Yamamoto, Yokohama (JP); Masafumi Morisue, Tokyo (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/141,055

(22) Filed: Sep. 25, 2018

(65) Prior Publication Data

US 2019/0023016 A1 Jan. 24, 2019

Related U.S. Application Data

(63) Continuation of application No. PCT/JP2017/009917, filed on Mar. 13, 2017.

(30) Foreign Application Priority Data

Mar. 29, 2016 (JP) ..... 2016-065628

(51) Int. Cl.
*B41J 2/14* (2006.01)
*B41J 2/18* (2006.01)
*F15D 1/00* (2006.01)

(52) U.S. Cl.
CPC ..... *B41J 2/1404* (2013.01); *B41J 2/18* (2013.01); *B41J 2/14072* (2013.01);
(Continued)

(58) Field of Classification Search
CPC .. B41J 2/1404; B41J 2/18; B41J 2002/14395; B41J 2/14072; B41J 2202/12; F15D 1/002; F15D 1/00
See application file for complete search history.

(56) References Cited

U.S. PATENT DOCUMENTS 6,244,694 B1 6/2001 Weber et al.
6,825,543 B2 11/2004 Shimotsusa et al.
(Continued)

FOREIGN PATENT DOCUMENTS

CN 1371134 A 9/2002
CN 1721190 A 1/2006
(Continued)

OTHER PUBLICATIONS

Office Action dated Jul. 9, 2019, in Chinese Patent Application No. 201780019939.4.
(Continued)

*Primary Examiner* — Geoffrey S Mruk
(74) *Attorney, Agent, or Firm* — Venable LLP

(57) ABSTRACT

A liquid ejection head includes an ejection orifice through which a liquid is ejected, a first liquid flow path which is in communication with the ejection orifice and through which the liquid flows, a second liquid flow path which is in communication with the ejection orifice on the opposite side of the first liquid flow path with respect to the ejection orifice 12 and through which the liquid flows, a first electrode positioned in the first liquid flow path 13, and a second electrode which is positioned in the second liquid flow path and generates an electro-osmotic flow in the liquid together with the first electrode.

15 Claims, 9 Drawing Sheets

(52) U.S. Cl.
CPC .. *B41J 2002/14395* (2013.01); *B41J 2202/12* (2013.01); *F15D 1/00* (2013.01); *F15D 1/002* (2013.01)

(56) References Cited

U.S. PATENT DOCUMENTS

| | | | | |
|---|---|---|---|---|
| 6,834,940 | B2 | 12/2004 | Sugioka et al. | |
| 7,056,798 | B2 | 6/2006 | Shimotsusa et al. | |
| 7,562,452 | B2 | 7/2009 | Komuro | |
| 7,950,769 | B2 | 5/2011 | Sakai et al. | |
| 8,091,235 | B2 | 1/2012 | Komuro | |
| 8,123,330 | B2 | 2/2012 | Sakai et al. | |
| 8,491,087 | B2 | 7/2013 | Sakai et al. | |
| 8,928,203 | B2 | 1/2015 | Kandori et al. | |
| 9,211,721 | B2 | 12/2015 | Govyadinov et al. | |
| 9,403,372 | B2 * | 8/2016 | Taff | B41J 2/17596 |
| 9,457,584 | B2 | 10/2016 | Govyadinov et al. | |
| 9,623,659 | B2 | 4/2017 | Govyadinov et al. | |
| 9,731,504 | B2 | 8/2017 | Sekine et al. | |
| 9,774,276 | B2 | 9/2017 | Kandori et al. | |
| 9,969,177 | B2 | 5/2018 | Govyadinov et al. | |
| 10,040,290 | B2 | 8/2018 | Okushima et al. | |
| 10,336,090 | B2 | 7/2019 | Govyadinov et al. | |
| 2005/0099458 | A1 * | 5/2005 | Edelen | B41J 2/04541 347/54 |
| 2014/0362143 | A1 | 12/2014 | Govyadinov et al. | |
| 2015/0070446 | A1 | 3/2015 | Taff et al. | |
| 2015/0109371 | A1 | 4/2015 | Ishida et al. | |
| 2017/0274647 | A1 | 9/2017 | Aoki et al. | |
| 2017/0366104 | A1 | 12/2017 | Kandori et al. | |
| 2018/0201024 | A1 | 7/2018 | Govyadinov et al. | |
| 2019/0001698 | A1 | 1/2019 | Yamazaki et al. | |
| 2019/0001699 | A1 | 1/2019 | Nakakubo et al. | |

FOREIGN PATENT DOCUMENTS

| | | | |
|---|---|---|---|
| CN | 1978198 | A | 6/2007 |
| CN | 102458692 | A | 5/2012 |
| CN | 103826860 | A | 5/2014 |
| JP | 2005-161547 | A | 6/2005 |
| JP | 2014-531349 | A | 11/2014 |
| TW | 201343413 | A | 11/2013 |
| WO | 2010/147942 | A1 | 12/2010 |
| WO | 2012/057758 | A1 | 5/2012 |
| WO | 2013/048382 | A1 | 4/2013 |
| WO | 2013/130039 | A1 | 9/2013 |

OTHER PUBLICATIONS

Extended European Search Report dated Oct. 17, 2019, in European Patent Application No. 17774227.7.
Office Action dated Oct. 29, 2019, in Japanese Patent Application No. 2016-065628.
International Search Report and Written Opinion dated May 9, 2017, in International Application No. PCT/JP2017/009917.
Russian Office Action dated Jun. 27, 2019 in Russian Patent Application No. 2018137786.
International Preliminary Report on Patentability dated Oct. 11, 2018, in International Application No. PCT/JP2017/009917.
Office Action dated Sep. 11, 2019, issued in Singaporean Patent Application No. 11201808349R.

* cited by examiner

LIQUID EJECTION HEAD AND METHOD FOR CIRCULATING LIQUID

CROSS-REFERENCE TO RELATED APPLICATIONS

This application is a Continuation of International Patent Application No. PCT/JP2017/009917, filed Mar. 13, 2017, which claims the benefit of Japanese Patent Application No. 2016-065628, filed Mar. 29, 2016, both of which are hereby incorporated by reference herein in their entirety.

BACKGROUND OF THE INVENTION

Field of the Invention

The present invention relates to a liquid ejection head and a method for circulating liquid, and more particularly, to a configuration for causing liquid to flow in the vicinity of an ejection orifice.

Description of the Related Art

In a liquid ejection head used in a liquid ejection apparatus that ejects liquid such as ink or the like, volatile components in the liquid are evaporated from an ejection orifice that ejects the liquid, such that the liquid in the vicinity of the ejection orifice is thickened. As a result, an ejection velocity of the ejected liquid droplet may be changed, or landing accuracy may be influenced. In particular, when an idle time after the ejection is performed is long, viscosity of the liquid is significantly increased and solid components of the liquid are stuck in the vicinity of the ejection orifice, such that a fluid resistance of the liquid is increased by the solid components, which may cause an ejection failure.

As one of the solutions for such a thickening phenomenon of the liquid, a method for causing a fresh liquid to flow through an ejection orifice in a pressure chamber is known. As a means for causing a liquid to flow, a method for circulating the liquid in the head by a differential pressure method is known. In addition, a method of using a μ pump such as an alternating current electro-osmotic flow (ACEOF) is known (International Publication No. WO 2013/130039).

In the case of a configuration of International Publication No. WO 2013/130039, it is possible to introduce the fresh liquid into the pressure chamber. However, since an electrode serving as a pump does not exist in a flow path on a downstream side of the ejection orifice, an effect of discharging the liquid concentrated inside the ejection orifice is small. For this reason, the concentrated liquid easily stays inside the pressure chamber. Therefore, the liquid inside the pressure chamber is easily thickened by the evaporation of the liquid from the ejection orifice.

An object of the present invention is to provide a liquid ejection head that reduces color unevenness in an image by alleviating a thickening of a liquid due to evaporation of the liquid from an ejection orifice.

SUMMARY OF THE INVENTION

The liquid ejection head according to the present invention includes an ejection orifice that ejects a liquid, a first liquid flow path which is in communication with the ejection orifice and through which the liquid flows, a second liquid flow path which is in communication with the ejection orifice on the opposite side of the first liquid flow path with respect to the ejection orifice and through which the liquid flows, a first electrode positioned in the first liquid flow path, and a second electrode which is positioned in the second liquid flow path and generates an electro-osmotic flow in the liquid together with the first electrode.

Further features of the present invention will become apparent from the following description of exemplary embodiments with reference to the attached drawings.

DESCRIPTION OF THE EMBODIMENTS

Hereinafter, a liquid ejection head according to exemplary embodiments of the present invention will be described with reference to the accompanying drawings. The respective exemplary embodiments below are directed to an ink jet recording head and an ink jet recording apparatus that eject ink, but the present invention is not limited thereto. The present invention is applicable to apparatuses such as a printer, a copy machine, a facsimile machine having a communication system, and a word processor having a printer part, or an industrial recording apparatus which is complexly combined with a variety of processing apparatuses. The present invention can also be used, for example, for the purposes such as biochip fabrication, electronic circuit printing, and application of resist for forming circuit patterns of semiconductor wafers.

The exemplary embodiments described below are preferred specific examples of the present invention and are imposed with various limitations which are technically preferred. However, in accordance with the scope of the present invention, the present invention is not limited to the exemplary embodiments described below.

First Exemplary Embodiment

Figure 1A:
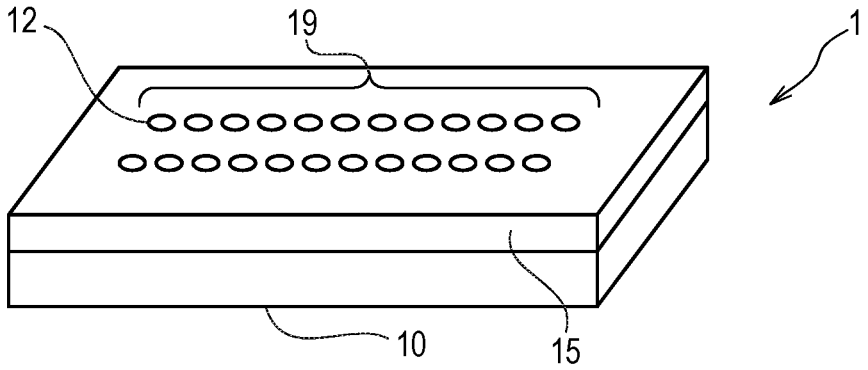
FIG. 1A is a schematic view of a liquid ejection head according to a first exemplary embodiment of the present invention.
Figure 1B:
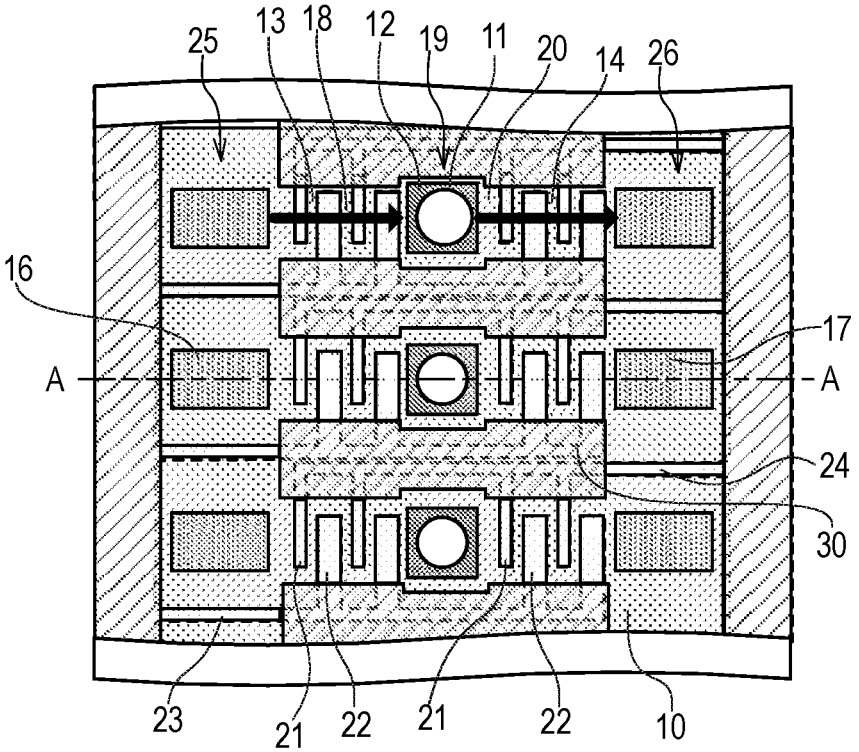
FIG. 1B is a schematic view of the liquid ejection head according to the first exemplary embodiment of the present invention.
Figure 1C:
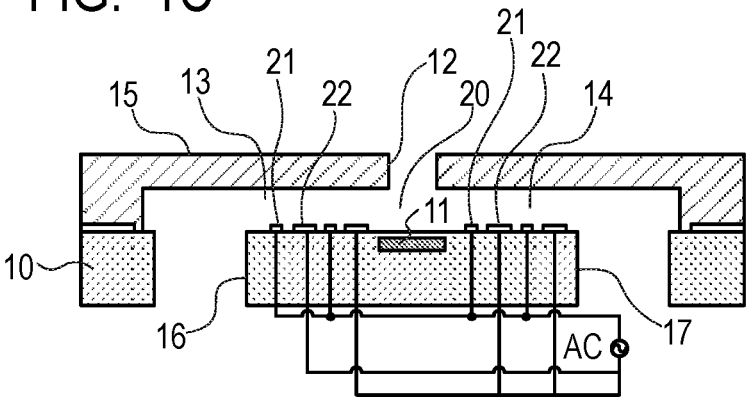
FIG. 1C is a schematic view of the liquid ejection head according to the first exemplary embodiment of the present invention.
Figure 1D:
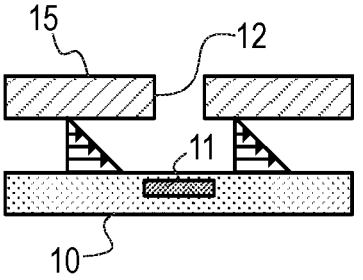
FIG. 1D is a schematic view of a flow rate distribution in the liquid ejection head according to the first exemplary embodiment of the present invention.

FIG. 1A is a perspective view of a recording element substrate of a liquid ejection head according to a first exemplary embodiment of the present invention. FIG. 1B is a cross-sectional view of the recording element substrate shown in FIG. 1A, FIG. 1C is a cross-sectional view taken along a line A-A of FIG. 1B, and FIG. 1D is a schematic view showing a flow rate distribution in the same cross section as FIG. 1C. A recording element substrate 1 has a substrate 10 and an ejection orifice forming member 15. The ejection orifice forming member 15 is bonded to the substrate 10. The substrate 10 includes an energy-generating element 11 which generates energy for ejecting ink. A plurality of ejection orifices 12 are disposed in the ejection orifice forming member 15. The plurality of ejection orifices 12 are arranged in series to form an ejection orifice array 19. The recording element substrate 1 according to the present exemplary embodiment has two ejection orifice arrays 19, but the number of the ejection orifice arrays 19 is not limited thereto.

Referring to FIGS. 1B and 1C, in the substrate 10, a plurality of first through-orifices 16 and a plurality of second through-orifices 17 that penetrate the substrate 10 from a surface to a rear surface are formed. In a space between the ejection orifice forming member 15 and the substrate 10, a plurality of first liquid flow paths 13 and a plurality of second liquid flow paths 14 through which ink flows are formed. The plurality of first liquid flow paths 13 and the plurality of second liquid flow paths 14 are partitioned by partition walls 30 with respect to an array direction of the ejection orifice 12 and are provided in parallel to each other. A plurality of pressure chambers 20 each having an energy-generating element 11 therein are formed between the ejection orifice forming member 15 and the substrate 10 and between the first liquid flow paths 13 and the second liquid flow paths 14. In the present invention, the pressure chamber 20 indicates an area sandwiched between the partition walls 30 and an area in which the energy-generating element 11 is provided. More broadly, the pressure chamber 20 indicates an area in which pressure acts when the energy-generating element 11 is driven. The ejection orifice 12 faces the energy-generating element 11 in a direction perpendicular to a surface facing the ejection orifice forming member 15 of the substrate 10. The pressure chamber 20, the first through-orifice 16, and the second through-orifice 17 are provided for each of the corresponding liquid flow paths or each of the ejection orifices 12. Therefore, the first through-orifice 16, the first liquid flow path 13, the pressure chamber 20, the second liquid flow path 14, and the second through-orifice 17 form an independent flow path for each ejection orifice 12. The plurality of first through-orifices 16 and the plurality of second through-orifices 17 form a first through-orifice array 25 and a second through-orifice array 26, respectively. The first through-orifice array 25 and the second through-orifice array 26 have an ejection orifice array 19 interposed therebetween and sides opposite to each other are extended to be in parallel to the ejection orifice array 19.

The ink is supplied to the pressure chamber 20 through the first liquid flow path 13 from the first through-orifice 16. The ink supplied to the pressure chamber 20 is heated by the energy-generating element 11 and is ejected from the ejection orifice 12 by pressure of generated bubbles. The ink which is not ejected from the ejection orifice 12 is guided to the second through-orifice 17 through the second liquid flow path 14 from the pressure chamber 20.

Two types of electrodes are provided in the first liquid flow path 13 and the second liquid flow path 14, respectively. Hereinafter, these electrodes are referred to as a first electrode 21 and a second electrode 22. Each of the first electrode 21 and the second electrode 22 is provided on the substrate 10. The first electrode 21 is connected to one terminal (a positive terminal) of an alternating current (AC) power source, and the second electrode 22 is connected to the other terminal (a negative terminal) of the AC power source. The first electrode 21 has a dimension smaller than that of the second electrode 22, with respect to a flow direction of the ink, that is, a direction along the first liquid flow path 13 and the second liquid flow path 14. Meanwhile, the dimensions of the first electrode 21 and the second electrode 22 in a direction orthogonal to the flow direction of the ink are almost the same. Therefore, an area of the first electrode 21 contacting the ink is smaller than the area of the second electrode 22 contacting the ink.

A plurality of first electrodes 21 and a plurality of second electrodes 22 are alternately provided in the first liquid flow path 13 and the second liquid flow path 14, respectively. The first electrodes 21 and the second electrodes 22 are provided in the order of the first electrode 21, the second electrode 22, the first electrode 21, the second electrode 22, . . . , from the first through-orifice 16 to the pressure chamber 20. However, at least one pair of the first electrode 21 and the second electrode 22 which are adjacent to each other may be provided in the first liquid flow path 13 and the second liquid flow path 14. The plurality of first electrodes 21 are connected to a common first wiring 24, and the plurality of second electrodes 22 are connected to a common second wiring 23. The first wiring 24 and the second wiring 23 are disposed on sides opposite to each other while having the first liquid flow path 13 and the second liquid flow path 14 interposed therebetween. The plurality of first electrodes 21 and the plurality of second electrodes 22 extend in a comb shape in a reverse direction to each other from the first wiring 24 and the second wiring 23. The first wiring 24 extends along the second liquid flow path 14 and also extends between the second through-orifices 17 adjacent to each other. The second wiring 23 extends along the first liquid flow path 13 and also extends between the first through-orifices 16 adjacent to each other. In addition, the first wiring 24 and the second wiring 23 are provided in a lower region of the partition wall 30 to be in parallel to each other. As a result, a complication of the first wiring 24 and the second wiring 23 is prevented and an increase in a dimension of the element substrate 10 is suppressed.

When the first electrode 21 and the second electrode 22 are energized, an AC potential is applied to the first electrode 21 and the second electrode 22. As a result, as shown in FIG. 1D, in the liquid flow path, a flow rate distribution in which a flow rate at a surface side of the substrate 10 is large and the flow rate gradually approaches zero as it approaches the ejection orifice forming member 15 is generated. The reason that such a flow rate distribution is generated will be described with reference to FIGS. 2A to 2D.

Figure 2A:
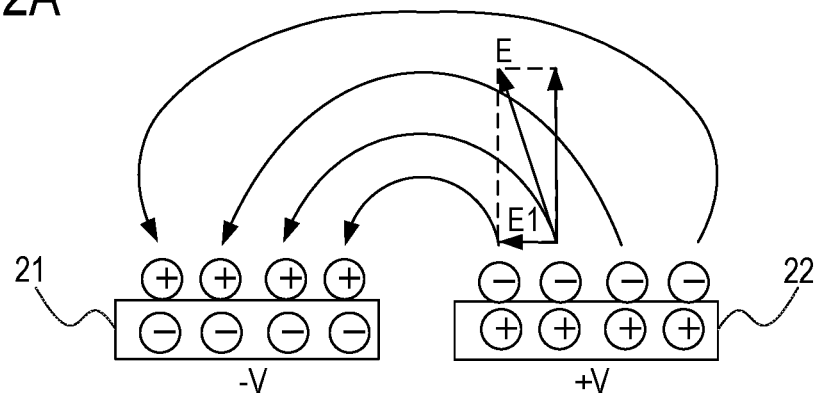
FIG. 2A is a schematic view for describing a mechanism of generating a driving force by an electro-osmotic flow.

An AC voltage is applied to the first electrode 21 and the second electrode 22, and a timing at which a negative voltage (−V) is applied to the first electrode 21 and a positive voltage (+V) is applied to the second electrode 22 is considered. In FIG. 2A, it is assumed that the first electrode 21 and the second electrode 22 have the same dimensions. As shown in FIG. 2A, an electric double layer is generated in the first electrode 21 and the second electrode. That is, the negative voltage (−V) is applied to the first electrode 21 and the ink contacting the first electrode 21 is positively charged, thereby forming the electric double layer. Similarly, the positive voltage (+V) is applied to the second electrode 22 and the ink contacting the second electrode 22 is negatively charged, thereby forming the electric double layer.

Figure 2B:
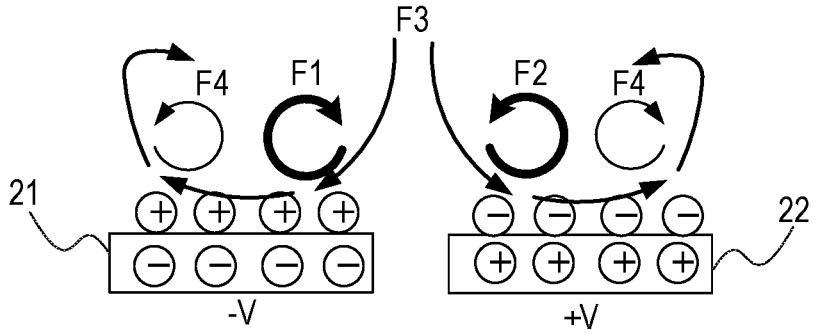
FIG. 2B is a schematic view for describing the mechanism of generating the driving force by the electro-osmotic flow.

In the ink, an electric field E of a substantially semicircular shape from the second electrode 22 toward the first electrode 21 is formed. Such an electric field is a symmetrical shape in relation to an intermediate line between the first electrode 21 and the second electrode 22. An electric field component E1 which is in parallel to surfaces of the first and second electrodes 21 and 22 is formed on the surfaces of the first and second electrodes 21 and 22. Such an electric field component E1 exerts Coulomb force on the charges induced on the first and second electrodes 21 and 22. A direction of the electric field component E1 is a left direction in the drawing at a position close to a gap between the electrodes. Since the positive charges are applied with force in the same direction as the electric field, a rotary eddy F1 in which the ink contacting the first electrode 21 flows in the left direction in the drawing is generated, as shown in FIG. 2B. Since the negative charges are applied with force opposite to that of the electric field, a rotary eddy F2 in which the ink contacting the second electrode 22 flows in a right direction in the drawing is generated. Since the ink flows in a direction away from the gap between the electrodes, an ink flow F3 such as to replenish the ink is generated in the gap between the electrodes. In addition, since the direction of the electric field is reversed at terminal portions of the electrode away from the gap between the electrodes, rotary eddies F4 in which the ink flows toward the gap between the electrodes are generated. However, since the electric field is weak, the Coulomb force applied to the ink is small. As a result, from the gap between the electrodes toward the first and second electrodes 21 and 22, a flow such as a stirring flow flowing in a direction away from the gap between the electrodes on the first and second electrodes 21 and 22 is formed. Such a flow is a bilateral symmetrical shape in the first electrode 21 and the second electrode 22.

Figure 2C:
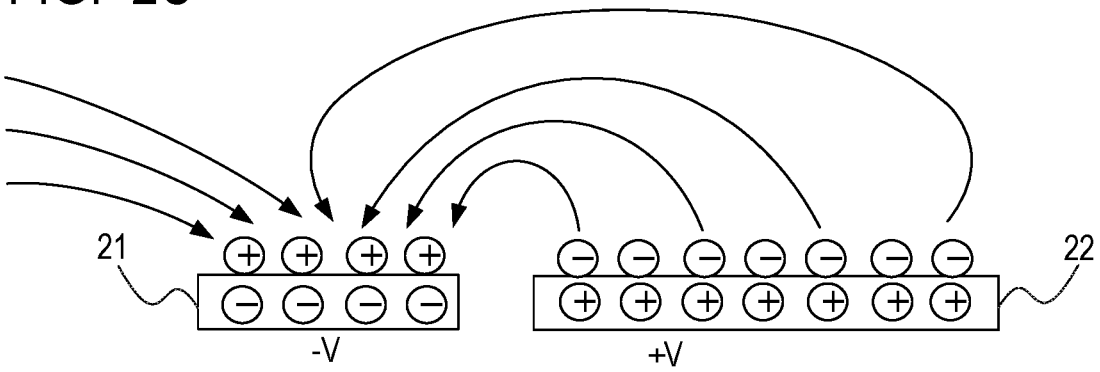
FIG. 2C is a schematic view for describing the mechanism of generating the driving force by the electro-osmotic flow.
Figure 2D:
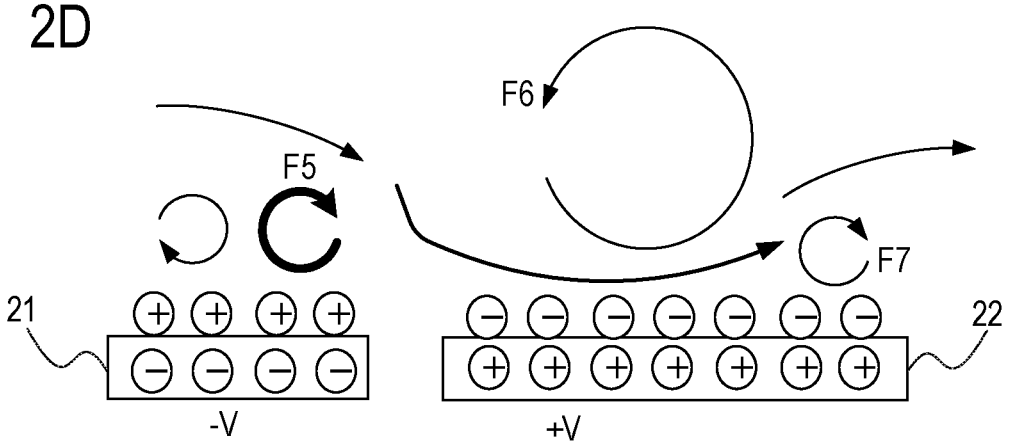
FIG. 2D is a schematic view for describing the mechanism of generating the driving force by the electro-osmotic flow.

Meanwhile, in FIGS. 2C and 2D, a dimension of the second electrode 22 in the flow path direction is larger than that of the first electrode 21 in the flow path direction. For this reason, an electric field distribution is different in the first electrode 21 and the second electrode 22. A small rotary eddy F5 having a fast flow rate is formed in the vicinity of the first electrode 21. In the vicinity of the second electrode 22, a small rotary eddy F7 having a slow flow rate is formed in a portion in which a potential is low, and a large rotary eddy F6 having a fast flow rate is formed in a portion in which the potential is high. As a result, the ink is drawn into the gap between the electrodes from the first electrode 21, such that an ink flow is generated in which the ink flows from the first electrode 21 toward the second electrode 22. The above description is the same even if the positive voltage (+V) is applied to the first electrode 21 and the negative voltage (−V) is applied to the second electrode. That is, even if a polarity of the applied voltage is inverted, since both the sign of the charge and the direction of the electric field are inverted, the direction of the generated flow is not changed. Therefore, a normal flow from the first electrode 21 having the small dimension in the flow direction toward the second electrode 22 having the large dimension in the flow direction is generated.

By such an electro-osmotic flow, driving force for causing the ink to flow from the first liquid flow path 13 toward the second liquid flow path 14 is generated. That is, by the electro-osmotic flow generated by the first electrode 21 and the second electrode 22 provided in the first liquid flow path 13, the ink is introduced into the pressure chamber 20 passing through the first liquid flow path 13 from the first through-orifice 16. When the energy-generating element 11 acts, a portion of the ink introduced into the pressure chamber 20 is ejected from the ejection orifice 12. The non-ejected ink is discharged to the outside of the liquid ejection head from the second through-orifice 17 passing through the second liquid flow path 14, by the electro-osmotic flow generated by the first electrode 21 and the second electrode 22 provided in the second liquid flow path 14. The ink discharged to the outside of the liquid ejection head passes through an ink tank or the like of the recording apparatus and is then introduced into the liquid ejection head again. Therefore, according to the exemplary embodiment of the present invention, the ink in the pressure chamber 20 is circulated between the pressure chamber 20 and the outside of the pressure chamber 20. Further, the present invention can also be applied to a configuration in which the ink is circulated in the liquid ejection head (the ink flows between the inside and the outside of the pressure chamber 20) as well as the configuration in which the ink is circulated between the liquid ejection head and the outside of the liquid ejection head.

Even when the energy-generating element 11 does not act, since the electro-osmotic flow by the AC power source connected to the first electrode 21 and the second electrode 22 is generated, the ink flows toward the second liquid flow path 14 from the first liquid flow path 13. Therefore, even if the ink is concentrated in the pressure chamber 20, retention of the concentrated ink in the pressure chamber 20 can be suppressed. Therefore, since a relatively fresh ink which is not thickened or has a small degree of thickening can be ejected from the ejection orifice 12, it is possible to reduce a color unevenness in an image.

Second Exemplary Embodiment

A configuration of a recording element substrate of a liquid ejection head according to a second exemplary embodiment of the present invention will be described with reference to FIGS. 3A to 3C. Further, in the following description, since a difference with the first exemplary embodiment will be mainly described, the description of the first exemplary embodiment is referred to for the part in which a specific description is omitted.

Figure 3A:
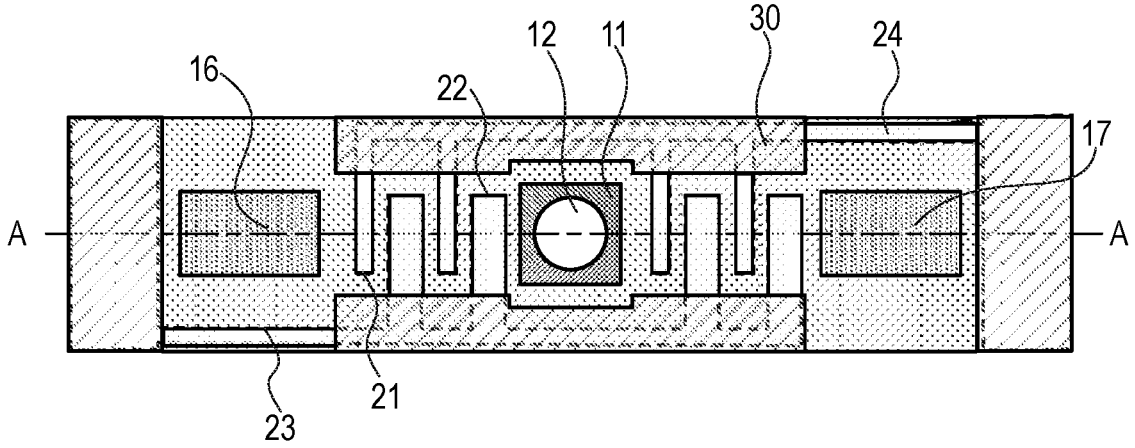
FIG. 3A is a schematic view of a liquid ejection head according to a second exemplary embodiment of the present invention.
Figure 3B:
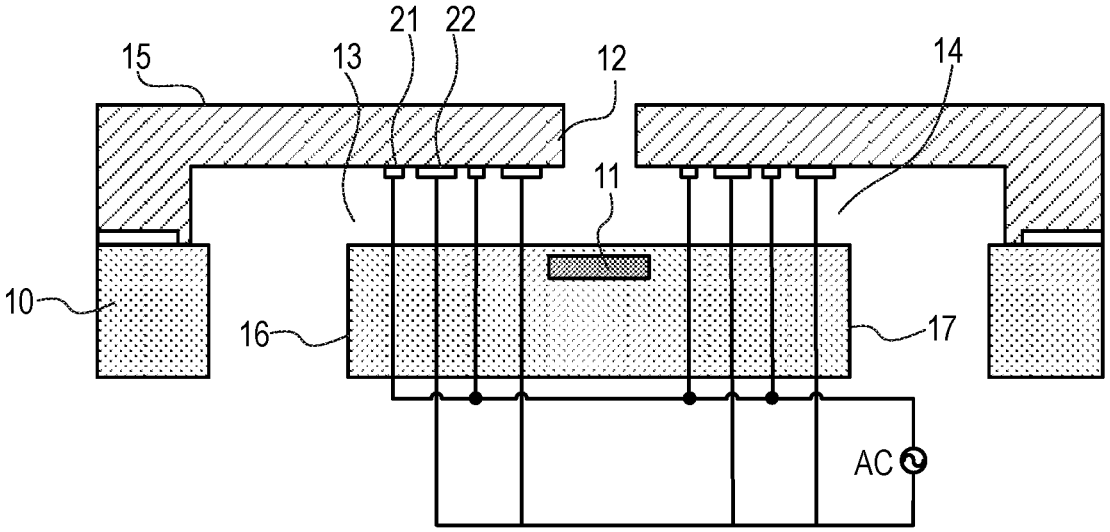
FIG. 3B is a schematic view of the liquid ejection head according to the second exemplary embodiment of the present invention.
Figure 3C:
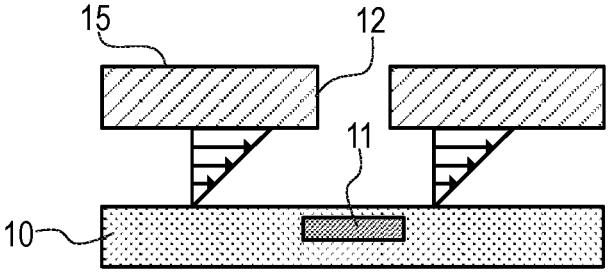
FIG. 3C is a schematic view of a flow rate distribution in the liquid ejection head according to the second exemplary embodiment of the present invention.

FIG. 3A is a cross-sectional view of a recording element substrate of a liquid ejection head according to the second exemplary embodiment of the present invention, FIG. 3B is a cross-sectional view taken along a line A-A of FIG. 3A, and FIG. 3C is a schematic view showing a flow rate distribution in the same cross section as FIG. 3B. FIG. 3A shows only one ejection orifice 12, the first and second liquid flow paths 13 and 14 and the first and second through-orifices 16 and 17 which are associated with one ejection orifice 12, but configurations of the ejection orifice array 19 and the first and second through-orifice arrays 25 and 26 are similar to those of the first exemplary embodiment.

In the present exemplary embodiment, the first electrode 21 and the second electrode 22 are disposed on a rear surface of the ejection orifice forming member 15. The rear surface means a surface which is in contact with the substrate 10 of the ejection orifice forming member 15. The charging of the electric double layer occurs on the electrodes on the rear surface of the ejection orifice forming member 15. For this reason, as shown in FIG. 3C, in the flow path, a flow rate distribution in which the flow rate is large at the rear surface side of the ejection orifice forming member 15 and the flow rate gradually approaches zero as it approaches the surface of the substrate 10 is generated. In a case in which the first electrode 21 and the second electrode 22 are driven with the same AC power source and the same frequency as those of the first exemplary embodiment, since the flow rate at the rear surface side of the ejection orifice forming member 15 is large, it is easy to eliminate the concentration of the ink in the ejection orifice 12. Therefore, the thickening of the ink may be more efficiently reduced.

Third Exemplary Embodiment

A configuration of a recording element substrate of a liquid ejection head according to a third exemplary embodiment of the present invention will be described with reference to FIGS. 4A to 4C. Further, in the following description, since a difference with the first exemplary embodiment will be mainly described, the description of the first exemplary embodiment is referred to for the part in which a specific description is omitted.

Figure 4A:
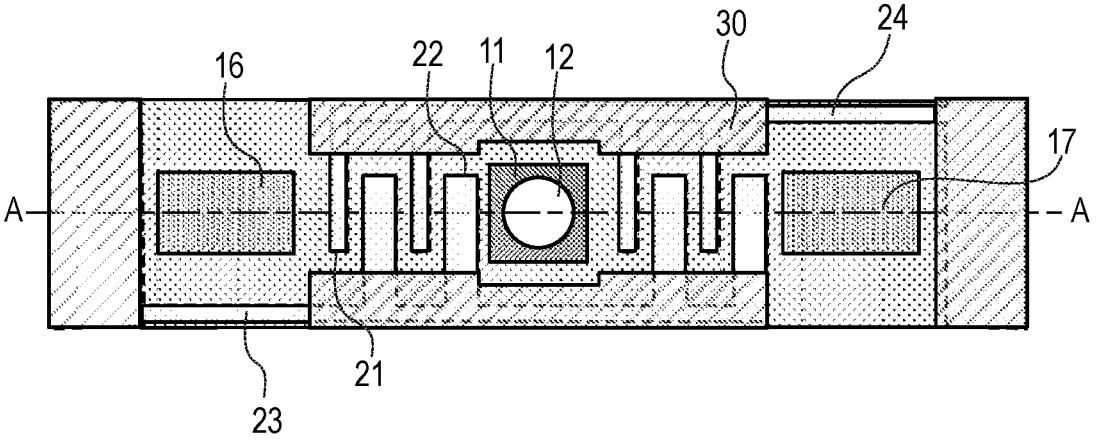
FIG. 4A is a schematic view of a liquid ejection head according to a third exemplary embodiment of the present invention.
Figure 4B:
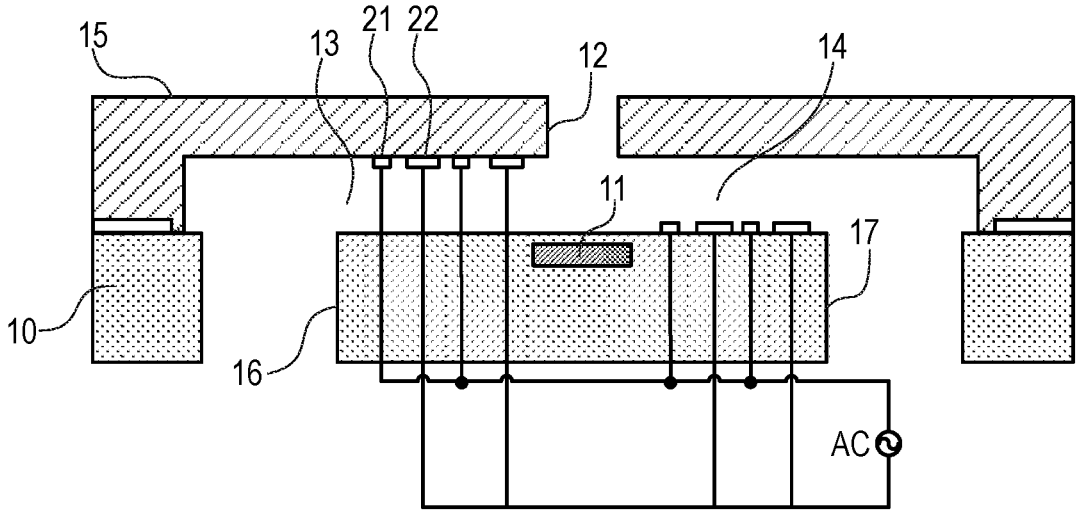
FIG. 4B is a schematic view of the liquid ejection head according to the third exemplary embodiment of the present invention.
Figure 4C:
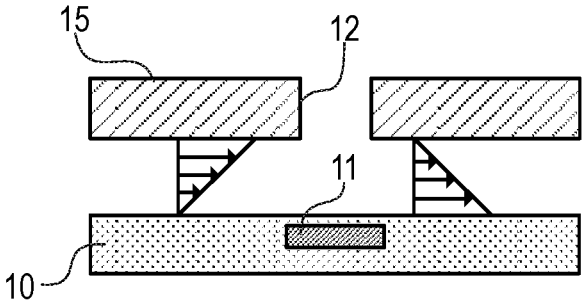
FIG. 4C is a schematic view of a flow rate distribution in the liquid ejection head according to the third exemplary embodiment of the present invention.

FIG. 4A is a cross-sectional view of a recording element substrate of a liquid ejection head according to the third exemplary embodiment of the present invention, FIG. 4B is a cross-sectional view taken along a line A-A of FIG. 4A, and FIG. 4C is a schematic view showing a flow rate distribution in the same cross section as FIG. 4B. FIG. 4A shows only one ejection orifice 12, the first and second liquid flow paths 13 and 14 and the first and second through-orifices 16 and 17 which are associated with one ejection orifice 12, but configurations of the ejection orifice array 19 and the first and second through-orifice arrays 25 and 26 are similar to those of the first exemplary embodiment.

In the present exemplary embodiment, the first electrode 21 and the second electrode 22 of the first liquid flow path 13 are provided on the rear surface of the ejection orifice forming member 15, and the first electrode 21 and the second electrode 22 of the second liquid flow path 14 are disposed on the substrate 10. The electrodes of the first liquid flow path 13 are provided on the rear surface of the ejection orifice forming member 15, thereby increasing the flow rate at the rear surface side of the ejection orifice forming member 15 and easily suppressing the concentration in the ejection orifice 12. In addition, the electrodes of the second liquid flow path 14 are disposed on the substrate 10, thereby easily discharging the concentrated ink. Therefore, in the present exemplary embodiment, it is easy to discharge the concentrated ink from the vicinity of the ejection orifice and to discharge the discharged concentrated ink from the pressure chamber 20 to the second through-orifice 17.

Fourth Exemplary Embodiment

A configuration of a recording element substrate of a liquid ejection head according to a fourth exemplary embodiment of the present invention will be described with reference to FIGS. 5A and 5B. Further, in the following description, since a difference with the first exemplary embodiment will be mainly described, the description of the first exemplary embodiment is referred to for the part in which a specific description is omitted.

Figure 5A:
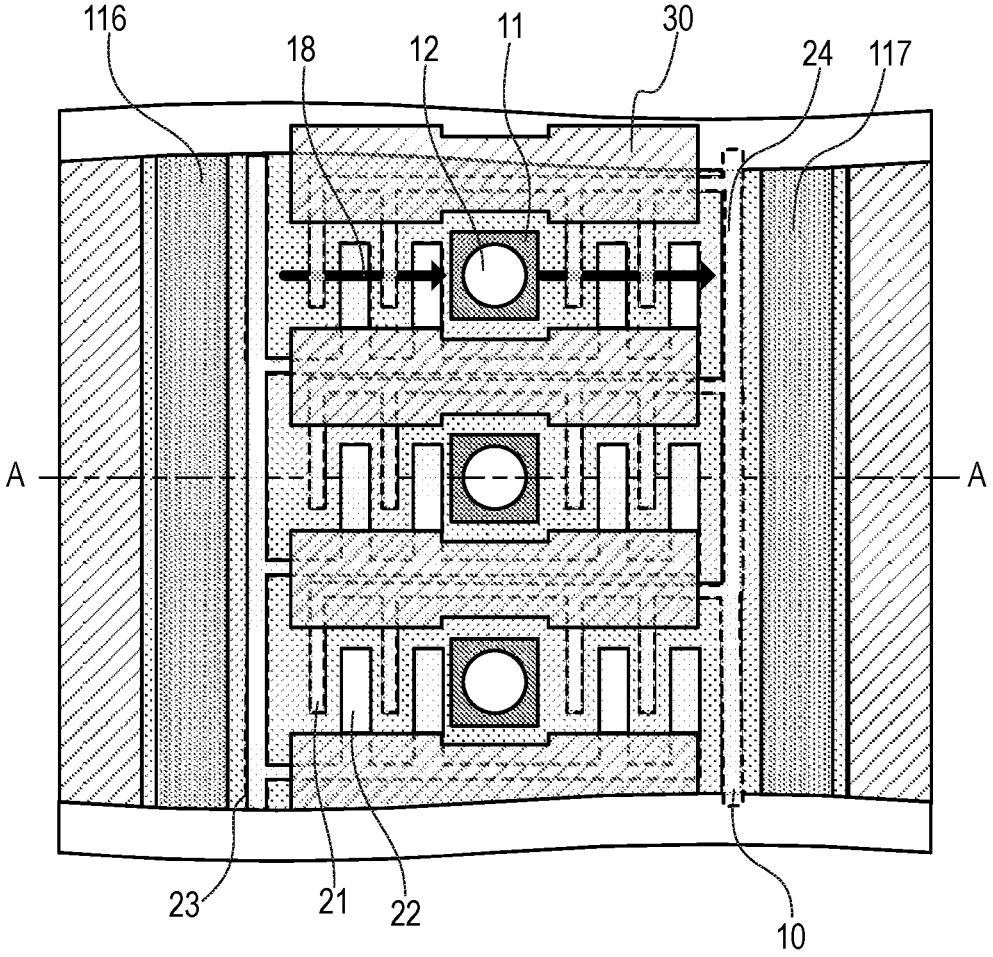
FIG. 5A is a schematic view of a liquid ejection head according to a fourth exemplary embodiment of the present invention.
Figure 5B:
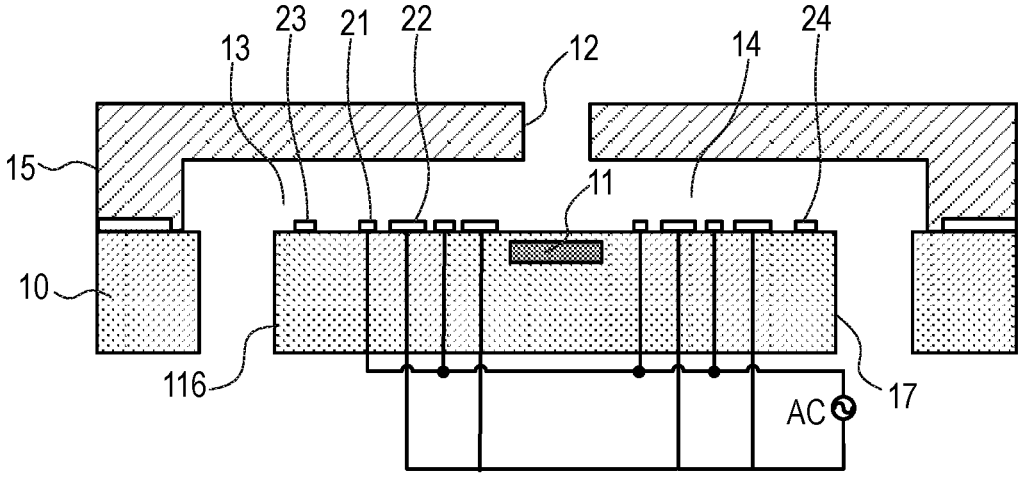
FIG. 5B is a schematic view of the liquid ejection head according to the fourth exemplary embodiment of the present invention.

FIG. 5A is a perspective view of a recording element substrate of a liquid ejection head according to a fourth exemplary embodiment of the present invention and FIG. 5B is a cross-sectional view of the recording element substrate shown in FIG. 5A.

In the present exemplary embodiment, two through-orifice arrays provided while having the ejection orifice array 19 interposed therebetween include a first one elongated through-orifice 116 and a second one elongated through-orifice 117, respectively. Since dimensions of the first one elongated through-orifice 116 and the second one elongated through-orifice 117 in a direction which is in parallel to the ejection orifice array 19 can be substantially increased, dimensions of the first one elongated through-orifice 116 and the second one elongated through-orifice 117 in a direction which is perpendicular to the ejection orifice array 19 can be decreased. For this reason, it is easy to shorten a dimension of the recording element substrate in a width direction as compared to the first exemplary embodiment and it is possible to miniaturize the recording element substrate. Either of the one elongated through-orifices may be provided for each of the liquid flow paths 13 and 14, similarly to the first exemplary embodiment.

Fifth Exemplary Embodiment

A configuration of a recording element substrate of a liquid ejection head according to a fifth exemplary embodiment of the present invention will be described with reference to FIGS. 6A and 6B. Further, in the following description, since a difference with the first exemplary embodiment will be mainly described, the description of the first exemplary embodiment is referred to for the part in which a specific description is omitted.

Figure 6A:
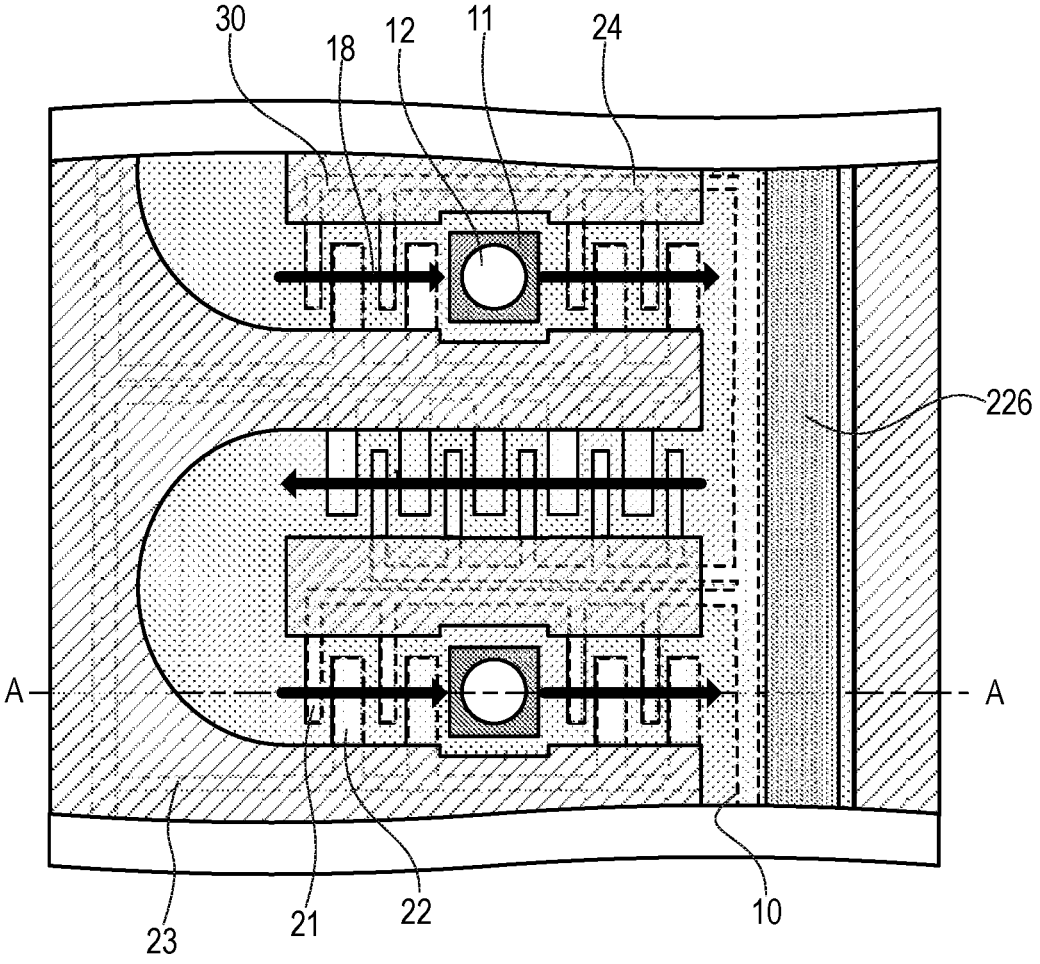
FIG. 6A is a schematic view of a liquid ejection head according to a fifth exemplary embodiment of the present invention.
Figure 6B:
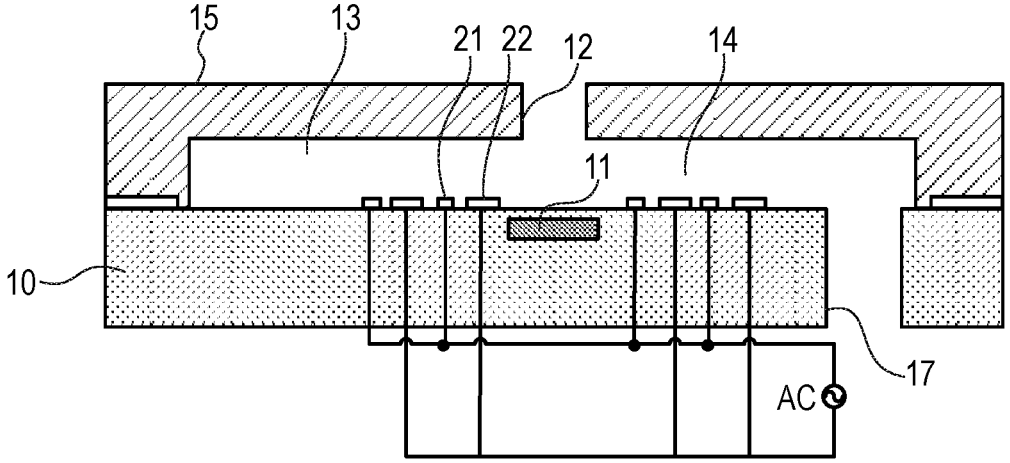
FIG. 6B is a schematic view of the liquid ejection head according to the fifth exemplary embodiment of the present invention.

FIG. 6A is a perspective view of a recording element substrate of a liquid ejection head according to a fifth exemplary embodiment of the present invention and FIG. 6B is a cross-sectional view of the recording element substrate shown in FIG. 6A.

In the present exemplary embodiment, one through-orifice 226 is provided for each ejection orifice 12. In addition, similarly to the fourth exemplary embodiment, one through-orifice 226 is common for the plurality of ejection orifices 12. The first liquid flow path 13 is connected to one through-orifice 226 and is connected to the pressure chamber 20 by changing a direction by 180 degrees in the middle. The second liquid flow path 14 connecting the pressure chamber 20 and one through-orifice 226 to each other is a flow path formed on a straight line. That is, the ink supplied to the pressure chamber 20 through the first liquid flow path 13 from the elongated one through-orifice 226 is again returned to the elongated through-orifice 226 through the second liquid flow path 14. According to the configuration of the present exemplary embodiment, since it is not necessary to dispose the two through-orifice arrays, it is easy to shorten the dimension of the recording element substrate in the width direction as compared to the first exemplary embodiment, and it is possible to miniaturize the recording element substrate. Further, it is also possible to provide a plurality of through-orifices connected to each ejection orifice 12, instead of the elongated through-orifice 226.

In the present exemplary embodiment, even when the ink is not ejected, a flow in which the ink introduced into the first liquid flow path 13 and the second liquid flow path 14 from one through-orifice 226 is again returned to one through-orifice 226 is formed. For this reason, similarly to the first exemplary embodiment, an effect of suppressing the retention of the concentrated ink is obtained.

Sixth Exemplary Embodiment

A configuration of a recording element substrate of a liquid ejection head according to a sixth exemplary embodiment of the present invention will be described with reference to FIGS. 7A to 7C. Further, in the following description, since a difference with the first exemplary embodiment will be mainly described, the description of the first exemplary embodiment is referred to for the part in which a specific description is omitted.

Figure 7A:
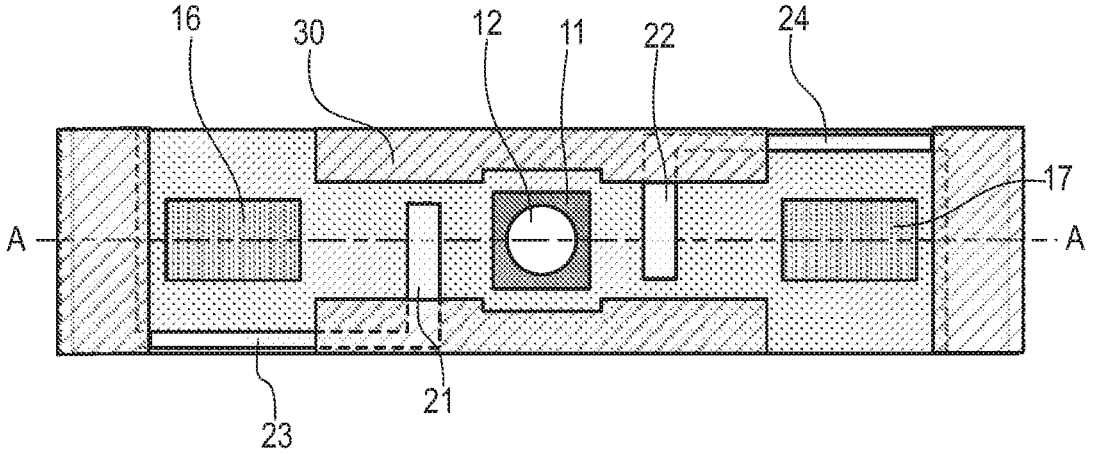
FIG. 7A is a schematic view of a liquid ejection head according to a sixth exemplary embodiment of the present invention.
Figure 7B:
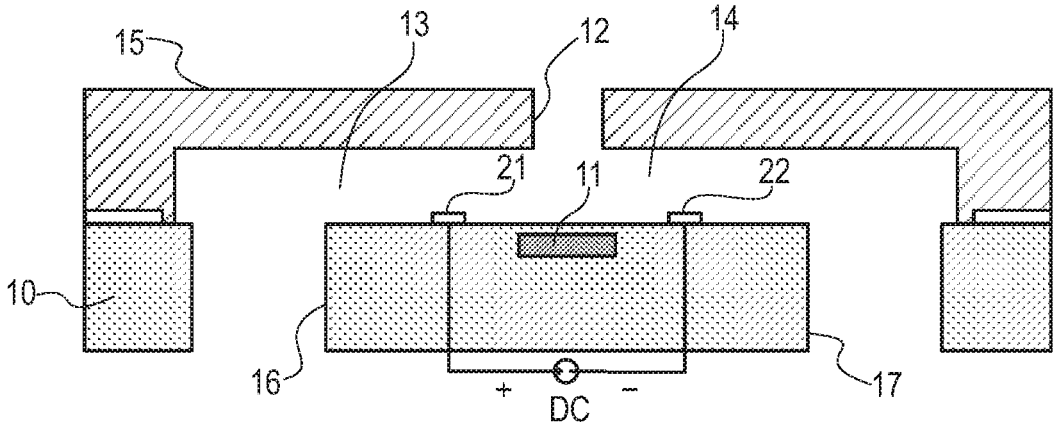
FIG. 7B is a schematic view of the liquid ejection head according to the sixth exemplary embodiment of the present invention.
Figure 7C:
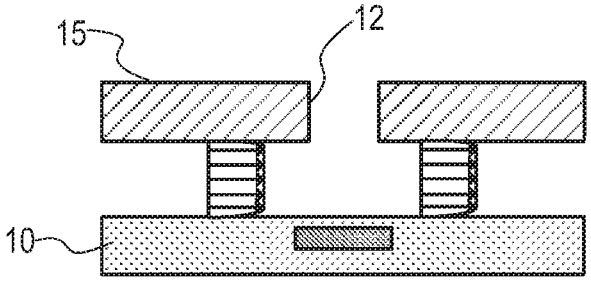
FIG. 7C is a schematic view of a flow rate distribution in the liquid ejection head according to the sixth exemplary embodiment of the present invention.

FIG. 7A is a cross-sectional view of a recording element substrate of a liquid ejection head according to the sixth exemplary embodiment of the present invention, FIG. 7B is a cross-sectional view taken along a line A-A of FIG. 7A, and FIG. 7C is a schematic view showing a flow rate distribution in the same cross section as FIG. 7B. FIG. 7A shows only one ejection orifice 12, the first and second liquid flow paths 13 and 14 and the first and second through-orifices 16 and 17 which are associated with one ejection orifice 12, but configurations of the ejection orifice array 19 and the first and second through-orifice arrays 25 and 26 are similar to those of the first exemplary embodiment.

In the present exemplary embodiment, the first electrode 21 is provided in the first liquid flow path 13 and the second electrode 22 is provided in the second liquid flow path 14, and the first electrode 21 and the second electrode 22 are connected to a direct current (DC) power source. More specifically, the first electrode 21 is connected to a positive pole of the DC power source and the second electrode 22 is connected to a negative pole of the DC power source. The dimensions of the first electrode 21 and the second electrode 22 are substantially the same as each other, but may be different from each other as in the first exemplary embodiment. The electrodes may be disposed on either of the substrate 10 and the rear surface of the ejection orifice forming member 15.

As shown in FIG. 7C, the flow rate distribution approximately shows a flow rate distribution close to a plug flow. The reason why such a flow rate distribution occurs is as follows. In a case in which an electric field which is in parallel to a wall surface is applied from the outside, a solid surface is negatively charged and positive ions are excessively present in the liquid in the vicinity of an interface. This is because the liquid is positively charged locally and ions of the electric double layer receive a force in the direction of the electric field, resulting in a movement of the ink in the vicinity of the wall. Due to the DC power source, it is necessary to drive the electrodes at a voltage at which electrolysis of the liquid does not occur (in the case of water, the voltage is preferably equal to or less than about 1V), and the obtained flow rate is small as compared to the case of using the AC power source. However, since the ink flow can be generated only by connecting the first electrode 21 and the second electrode 22 to the DC power source, a simple configuration is obtained as compared to the first exemplary embodiment.

Further, the present exemplary embodiment has the configuration in which the first and second electrodes are provided on the substrate 10, but the present invention is not limited thereto and can also be applied to a configuration in which the first and second electrodes are provided on the rear surface of the ejection orifice forming member 15 as described in the second exemplary embodiment. In addition, the present invention can also be applied to a configuration in which one of the first and second electrodes is provided on the substrate 10 and the other is provided on the ejection orifice forming member 15 as described in the third exemplary embodiment.

Seventh Exemplary Embodiment

A configuration of a recording element substrate of a liquid ejection head according to a seventh exemplary embodiment of the present invention will be described with reference to FIGS. 8A to 8C. Further, in the following description, since a difference with the first exemplary embodiment will be mainly described, the description of the first exemplary embodiment is referred to for the part in which a specific description is omitted.

Figure 8A:
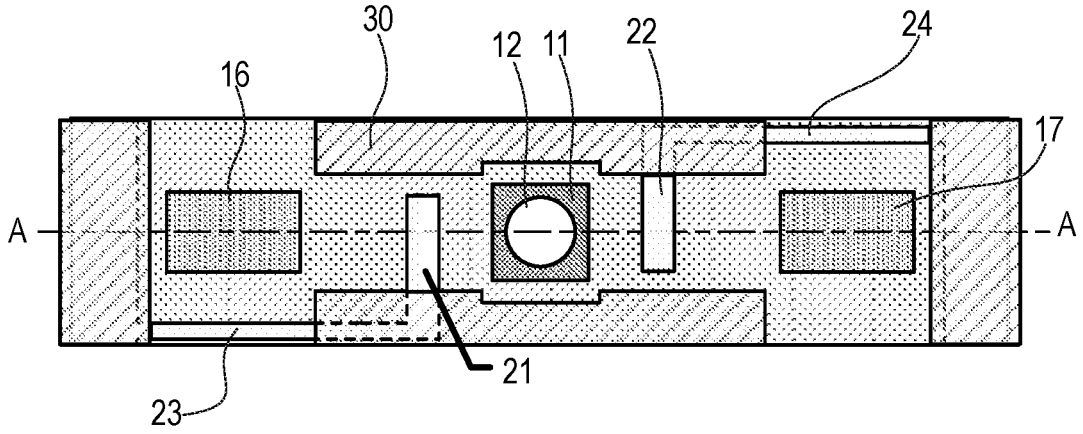
FIG. 8A is a schematic view of a liquid ejection head according to a seventh exemplary embodiment of the present invention.
Figure 8B:
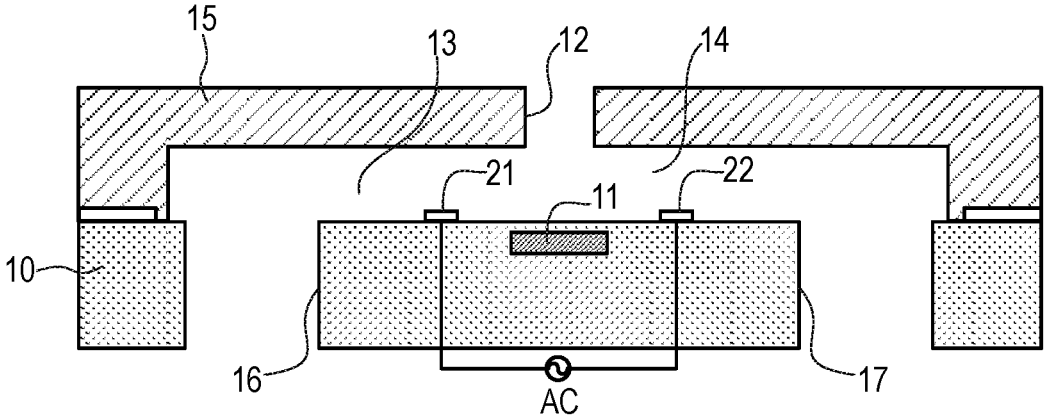
FIG. 8B is a schematic view of the liquid ejection head according to the seventh exemplary embodiment of the present invention.
Figure 8C:
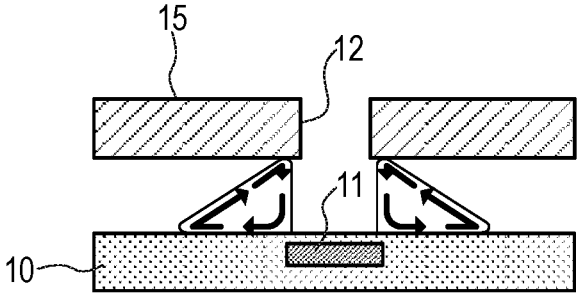
FIG. 8C is a schematic view of a flow rate distribution in the liquid ejection head according to the seventh exemplary embodiment of the present invention.

FIG. 8A is a cross-sectional view of a recording element substrate of a liquid ejection head according to the seventh exemplary embodiment of the present invention, FIG. 8B is a cross-sectional view taken along a line A-A of FIG. 8A, and FIG. 8C is a schematic view showing a flow rate distribution in the same cross section as FIG. 8B. FIG. 8A shows only one ejection orifice 12, the first and second liquid flow paths 13 and 14 and the first and second through-orifices 16 and 17 which are associated with one ejection orifice 12, but configurations of the ejection orifice array 19 and the first and second through-orifice arrays 25 and 26 are similar to those of the first exemplary embodiment.

In the present exemplary embodiment, the first electrode 21 is provided in the first liquid flow path 13 and the second electrode 22 is provided in the second liquid flow path 14, and the first electrode 21 and the second electrode 22 are connected to a positive (+) terminal and a negative (−) terminal of the AC power source, respectively. The dimensions of the first electrode 21 and the second electrode 22 are substantially equal to each other.

As shown in FIG. 8C, in the present exemplary embodiment, a flow rate distribution such as a mixer that substantially rotates about the ejection orifice 12 or the energy-generating element 11 is generated. The reason is as described in FIGS. 2A and 2B. Since a flow component passing through the vicinity of the ejection orifice 12 is formed, it is possible to cause the concentrated ink in the vicinity of the ejection orifice 12 to flow. Therefore, the concentration of the ink in the vicinity of the ejection orifice 12 can be suppressed. Since the electrodes are connected to the AC power source, an occurrence of bubbles due to the electrolysis is suppressed, thereby making it possible to achieve a high voltage. For this reason, it is easy to cause the ink to flow at a higher flow rate as compared to the sixth exemplary embodiment. Therefore, it is possible to achieve a high flow rate of the ink with a simple configuration.

Eighth Exemplary Embodiment

A configuration of a recording element substrate of a liquid ejection head according to an eighth exemplary embodiment of the present invention will be described with reference to FIGS. 9A to 9E. Further, in the following description, since a difference with the first exemplary embodiment will be mainly described, the description of the first exemplary embodiment is referred to for the part in which a specific description is omitted.

Figure 9A:
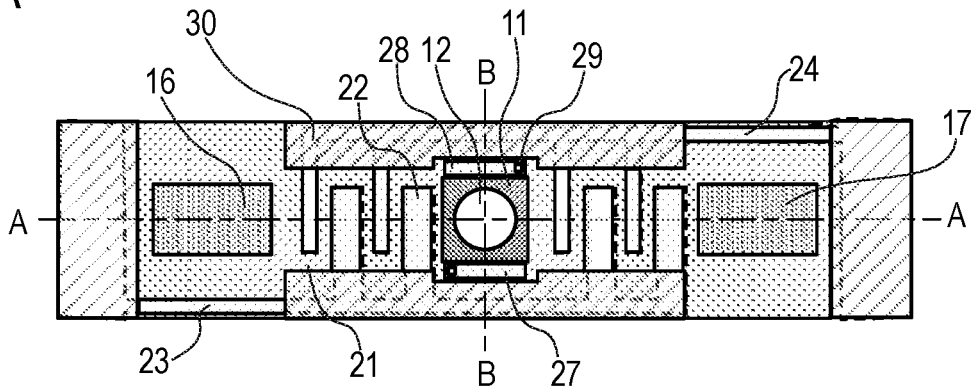
FIG. 9A is a schematic view of a liquid ejection head according to an eighth exemplary embodiment of the present invention.
Figure 9B:
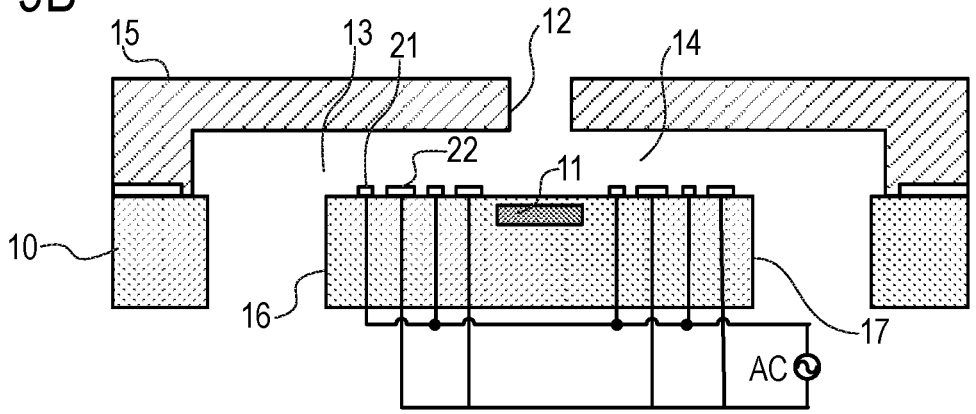
FIG. 9B is a schematic view of the liquid ejection head according to the eighth exemplary embodiment of the present invention.
Figure 9C:
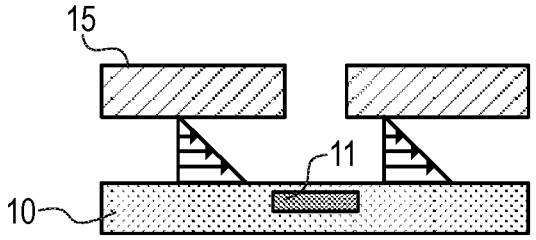
FIG. 9C is a schematic view of the liquid ejection head according to the eighth exemplary embodiment of the present invention.
Figure 9D:
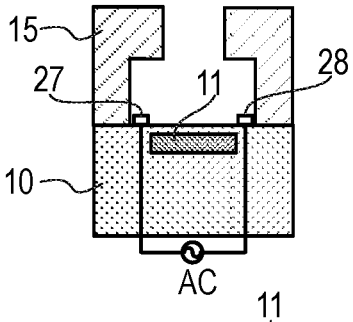
FIG. 9D is a schematic view of a flow rate distribution in the liquid ejection head according to the eighth exemplary embodiment of the present invention.
Figure 9E:
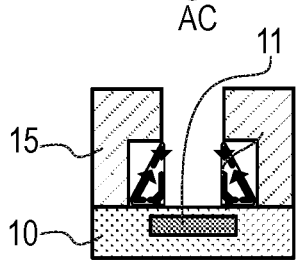
FIG. 9E is a schematic view of the flow rate distribution in the liquid ejection head according to the eighth exemplary embodiment of the present invention.

FIG. 9A is a cross-sectional view of a recording element substrate of a liquid ejection head according to the eighth exemplary embodiment of the present invention, FIG. 9B is a cross-sectional view taken along a line A-A of FIG. 9A, and FIG. 9C is a schematic view showing a flow rate distribution in the same cross section as FIG. 9B. FIG. 9D is a cross-sectional view taken along a line B-B of FIG. 9A and FIG. 9E is a schematic view showing a flow rate distribution in the same cross section as FIG. 9D. FIG. 9A shows only one ejection orifice 12, the first and second liquid flow paths 13 and 14 and the first and second through-orifices 16 and 17 which are associated with one ejection orifice 12, but configurations of the ejection orifice array 19 and the first and second through-orifice arrays 25 and 26 are similar to those of the first exemplary embodiment.

In the present exemplary embodiment, in addition to the first electrode 21 and the second electrode 22, a third electrode 27 and a fourth electrode 28 are formed. The third electrode 27 and the fourth electrode 28 are each connected to wirings (not shown) by vias 29. The first electrode 21 and the second electrode 22 have the configurations similar to the first exemplary embodiment and specifically have the following configurations. First, the first electrode 21 and the second electrode 22 are connected to the positive (+) terminal and the negative (−) terminal of the AC power source. The first electrode 21 and the second electrode 22 are disposed together in the first liquid flow path 13 and the second liquid flow path 14. A dimension of the first electrode 21 in a flow path direction is smaller than a dimension of the second electrode 22 in the flow path direction. The first electrode 21 and the second electrode 22 are disposed on the substrate 10. The third electrode 27 and the fourth electrode 28 are connected to both poles of the AC power source, and are disposed at both sides while having the ejection orifice 12 or the energy-generating element 11 interposed therebetween, unlike the sixth exemplary embodiment. The third electrode 27 and the fourth electrode 28 may be disposed in any of the first liquid flow path 13, the second liquid flow path 14, and the pressure chamber 20.

By the first electrode 21 and the second electrode 22, an ink flow from the first liquid flow path 13 toward the second liquid flow path 14 is generated. For this reason, a fresh ink flow across the pressure chamber 20 is generated. In addition, as shown in FIG. 9E, by the third electrode 27 and the fourth electrode 28, a flow component toward the ejection orifice 12 is generated. For this reason, the concentration of the ink in the ejection orifice 12 can be efficiently suppressed. In the present exemplary embodiment, by combining the two configurations above, an effect of reducing the thickening of the ink is greater than in other exemplary embodiments.

According to the present invention, the thickening of the liquid due to the evaporation of the liquid from the ejection orifice is reduced by introducing the liquid into the pressure chamber and discharging the liquid from the pressure chamber, thereby making it possible to reduce the color unevenness in the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid ejection head comprising:

an ejection orifice through which a liquid is ejected;

a pressure chamber provided at a position corresponding to the ejection orifice;

a first liquid flow path which is in communication with the ejection orifice;

a second liquid flow path which is in communication with the ejection orifice;

a first electrode provided in the first liquid flow path; and a second electrode provided in the second liquid flow path, an electro-osmotic flow directed from the first liquid flow path to the second liquid flow path being generated by applying a voltage to the first electrode and the second electrode, wherein the liquid is supplied from the first liquid flow path to the pressure chamber, with a part of the liquid supplied to the pressure chamber being ejected from the ejection orifice due to application of pressure, and another part of the liquid supplied to the pressure chamber being supplied to the second liquid flow path without being ejected from the ejection orifice.

2. The liquid ejection head according to claim 1, further comprising:

an energy-generating element provided in the pressure chamber for generating energy for ejecting the liquid; and a substrate provided with the energy-generating element, wherein the first electrode and the second electrode are disposed on the substrate.

3. The liquid ejection head according to claim 1, further comprising an ejection orifice forming member provided with the ejection orifice, wherein the first electrode and the second electrode are disposed on the ejection orifice forming member.

4. The liquid ejection head according to claim 1, further comprising:

an energy-generating element provided in the pressure chamber for generating energy for ejecting the liquid;

a substrate provided with the energy-generating element; and an ejection orifice forming member provided with the ejection orifice, wherein the first electrode is disposed on the substrate and the second electrode is disposed on the ejection orifice forming member.

5. The liquid ejection head according to claim 1, wherein the first electrode is connected to one terminal of an alternating current (AC) power source and the second electrode is connected to the other terminal of the AC power source.

6. The liquid ejection head according to claim 5, wherein at least one first electrode is disposed in each of the first and second liquid flow paths and at least one second electrode is disposed in each of the first and second liquid flow paths, and in each of the first and second liquid flow paths, the first electrode and the second electrode are alternately disposed, and dimensions of the first and second electrodes in directions along the first and second liquid flow paths are different from each other.

7. The liquid ejection head according to claim 6, further comprising:

third and fourth electrodes disposed in the pressure chamber, the first liquid flow path, or the second liquid flow path with the ejection orifice interposed therebetween, wherein the third electrode is connected to one terminal of a second AC power source and the fourth electrode is connected to the other terminal of the second AC power source.

8. The liquid ejection head according to claim 5, wherein one first electrode is disposed in the first liquid flow path, one second electrode is disposed in the second liquid flow path, and a dimension of the first electrode in a direction along the first liquid flow path is equal to a dimension of the second electrode in a direction along the second liquid flow path.

9. The liquid ejection head according to claim 1, wherein the first electrode is connected to one terminal of a direct current (DC) power source and the second electrode is connected to the other terminal of the DC power source.

10. The liquid ejection head according to claim 1, further comprising a through-orifice penetrating through a substrate provided with an energy-generating element which generates energy for ejecting the liquid, and connected to the first liquid flow path or the second liquid flow path, wherein the through-orifice is provided for each of the first liquid flow path or the second liquid flow path.

11. The liquid ejection head according to claim 1, further comprising a through-orifice penetrating through a substrate provided with an energy-generating element which generates energy for ejecting the liquid, and connected to the first liquid flow path or the second liquid flow path, wherein the through-orifice is shared by a plurality of first liquid flow paths and a plurality of second liquid flow paths.

12. The liquid ejection head according to claim 1, wherein the liquid in the pressure chamber is circulated between the pressure chamber and outside of the pressure chamber.

13. A liquid ejection head comprising:

an ejection orifice through which a liquid is ejected;

a pressure chamber provided at a position corresponding to the ejection orifice;

a first liquid flow path which is in communication with the ejection orifice;

a second liquid flow path which is in communication with the ejection orifice; and a first electrode and a second electrode provided in the first liquid flow path and the second liquid flow path, respectively, for generating an electro-osmotic flow directed from the first liquid flow path to the second liquid flow path by being applied with a voltage, wherein the liquid is supplied from the first liquid flow path to the pressure chamber, with a part of the liquid supplied to the pressure chamber being ejected from the ejection orifice due to application of pressure, and another part of the liquid supplied to the pressure chamber being supplied to the second liquid flow path without being ejected from the ejection orifice.

14. The liquid ejection head according to claim 13, wherein the first electrode is connected to one terminal of an AC power source and the second electrode is connected to the other terminal of the AC power source.

15. The liquid ejection head according to claim 13, wherein dimensions of the first electrode and the second electrode in directions along the first and second liquid flow paths are different from each other.

* * * * *